US010636438B2

(12) United States Patent
Nakayama et al.

(10) Patent No.: US 10,636,438 B2
(45) Date of Patent: Apr. 28, 2020

(54) METHOD, INFORMATION PROCESSING APPARATUS FOR PROCESSING SPEECH, AND NON-TRANSITORY COMPUTER-READABLE STORAGE MEDIUM

(71) Applicant: FUJITSU LIMITED, Kawasaki-shi, Kanagawa (JP)

(72) Inventors: Sayuri Nakayama, Kawasaki (JP); Taro Togawa, Kawasaki (JP); Takeshi Otani, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 16/113,125

(22) Filed: Aug. 27, 2018

(65) Prior Publication Data

US 2019/0066714 A1 Feb. 28, 2019

(30) Foreign Application Priority Data

Aug. 29, 2017 (JP) ..... 2017-164725

(51) Int. Cl.

| | |
|---|---|
| ***G10L 25/51*** | (2013.01) |
| ***G10L 25/06*** | (2013.01) |
| ***G10L 25/90*** | (2013.01) |
| ***G10L 25/78*** | (2013.01) |
| *G10L 25/18* | (2013.01) |

(52) U.S. Cl.

CPC ..... *G10L 25/90* (2013.01); *G10L 25/51* (2013.01); *G10L 25/78* (2013.01); *G10L 25/06* (2013.01); *G10L 25/18* (2013.01)

(58) Field of Classification Search

CPC ..... G10L 11/00; G10L 11/04; G10L 25/90

USPC ..... 704/207, 233

See application file for complete search history.

(56) References Cited

U.S. PATENT DOCUMENTS

| | | | | |
|---|---|---|---|---|
| 4,637,046 A * | 1/1987 | Sluijter | G10L 25/93 | 704/214 |
| 5,189,701 A * | 2/1993 | Jain | G10L 25/90 | 704/207 |
| 5,799,276 A * | 8/1998 | Komissarchik | G10L 15/04 | 704/207 |
| 6,526,376 B1 * | 2/2003 | Villette | G10L 25/90 | 704/207 |

(Continued)

FOREIGN PATENT DOCUMENTS

| | | |
|---|---|---|
| JP | 2002-515609 | 5/2002 |
| JP | 2002-516420 | 6/2002 |

*Primary Examiner* — Akwasi M Sarpong

(74) *Attorney, Agent, or Firm* — Fujitsu Patent Center

(57) ABSTRACT

A method for processing speech includes: executing a acquiring process that includes acquiring a speech signal; executing a detection process that includes detecting a first frequency spectrum from the speech signal; executing a calculation process that includes calculating a second spectrum based on an envelope of the first spectrum; executing a correction process that includes correcting the first spectrum based on comparison between a first amplitude of the first spectrum and a second amplitude of the second spectrum; executing a estimation process that includes estimating a pitch frequency of the speech signal in accordance with correlation between the corrected first frequency spectrum and periodic signals corresponding to frequencies in a certain band.

20 Claims, 20 Drawing Sheets

(56) References Cited

U.S. PATENT DOCUMENTS

| | | | | |
|---|---|---|---|---|
| 6,885,986 | B1 * | 4/2005 | Gigi | G10L 25/90 704/207 |
| 2005/0049875 | A1 * | 3/2005 | Kawashima | G10L 13/033 704/266 |
| 2010/0318350 | A1 * | 12/2010 | Endo | G10L 21/038 704/209 |
| 2013/0041669 | A1 * | 2/2013 | Ben-David | G10L 13/08 704/260 |
| 2016/0062982 | A1 * | 3/2016 | Wroczynski | G06F 17/2872 704/9 |
| 2016/0111084 | A1 * | 4/2016 | Bang | G10L 15/32 704/251 |

* cited by examiner

| | SPECTRUM | CORRELATION VALUES | ESTIMATED VALUE |
|---|---|---|---|
| EXAMPLE OF RELATED ART |   | f [Hz]: 0.7<br>2f [Hz]: 0.8 | 2f [Hz]<br>INCORRECT |
| PRESENT TECHNIQUE |   | f [Hz]: 0.9<br>2f [Hz]: 0.7 | f [Hz]<br>CORRECT |

METHOD, INFORMATION PROCESSING APPARATUS FOR PROCESSING SPEECH, AND NON-TRANSITORY COMPUTER-READABLE STORAGE MEDIUM

CROSS-REFERENCE TO RELATED APPLICATION

This application is based upon and claims the benefit of priority of the prior Japanese Patent Application No. 2017-164725, filed on Aug. 29, 2017, the entire contents of which are incorporated herein by reference.

FIELD

The embodiments discussed herein are related to a method, an information processing apparatus for processing speech, and a non-transitory computer-readable storage medium.

BACKGROUND

During these years, many companies desire to obtain information regarding customers' (or employees') emotions from conversation between the employees and the customers in order to estimate the customers' satisfaction levels and improve the quality of marketing. Human emotions often exhibit through voice, and the pitch (pitch frequency) of voice is one of important factors in identifying human emotions.

An example of the related art for estimating a pitch frequency will be described. FIG. 18 is a first diagram illustrating the example of the related art. As illustrated in FIG. 18, the example of the related art includes a frequency conversion unit 10, a correlation calculation unit 11, and an identification unit 12.

The frequency conversion unit 10 is a processing unit that calculates a frequency spectrum of an input speech sound by performing a Fourier transform on the input speech sound. The frequency conversion unit 10 outputs the frequency spectrum of the input speech sound to the correlation calculation unit 11. In the following description, a frequency spectrum of an input speech sound will be referred to as an "input spectrum".

The correlation calculation unit 11 is a processing unit that calculates correlation values between cosine waves of various frequencies and an input spectrum. The correlation calculation unit 11 outputs information in which the frequencies of the cosine waves and the correlation values are associated with each other to the identification unit 12.

The identification unit 12 is a processing unit that outputs the frequency of a cosine wave associated with a largest correlation value as a pitch frequency.

FIG. 19 is a second diagram illustrating the example of the related art. In FIG. 19, an input spectrum 5*a* is output from the frequency conversion unit 10. A horizontal axis for the input spectrum 5*a* represents frequency, and a vertical axis represents the amplitude of the input spectrum 5*a*.

Cosine waves 6*a* and 6*b* are part of cosine waves received by the correlation calculation unit 11. The cosine wave 6*a* has peaks thereof at a frequency f [Hz] and multiples of the frequency f [Hz] along the frequency axis. The cosine wave 6*b* has peaks thereof at a frequency 2*f* [Hz] and multiples of the frequency 2*f* [Hz].

The correlation calculation unit 11 calculates a correlation value of 0.95 between the input spectrum 5*a* and the cosine wave 6*a*. The correlation calculation unit 11 also calculates a correlation value of 0.40 between the input spectrum 5*a* and the cosine wave 6*b*.

The identification unit 12 compares correlation values and identifies a largest correlation value. In the example illustrated in FIG. 19, the correlation value of 0.95 is the largest value, and the identification unit 12 outputs the frequency f [Hz] associated with the correlation value of 0.95 as a pitch frequency.

Examples of the related art include Japanese National Publication of International Patent Application No. 2002-516420 and Japanese National Publication of International Patent Application No. 2002-515609.

SUMMARY

According to an aspect of the invention, a method for processing speech includes: executing a acquiring process that includes acquiring a speech signal; executing a detection process that includes detecting a first frequency spectrum from the speech signal; executing a calculation process that includes calculating a second spectrum based on an envelope of the first spectrum; executing a correction process that includes correcting the first spectrum based on comparison between a first amplitude of the first spectrum and a second amplitude of the second spectrum; executing a estimation process that includes estimating a pitch frequency of the speech signal in accordance with correlation between the corrected first frequency spectrum and periodic signals corresponding to frequencies in a certain band.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

There is a problem in the above-described example of the related art in that it is difficult to improve the accuracy of estimating a pitch frequency.

There might be decreases in an input spectrum or some harmonics, for example, due to telephone bandwidth shaping, a surrounding environment, or the like. In this case, it is difficult to accurately estimate a pitch frequency.

Figure 20:
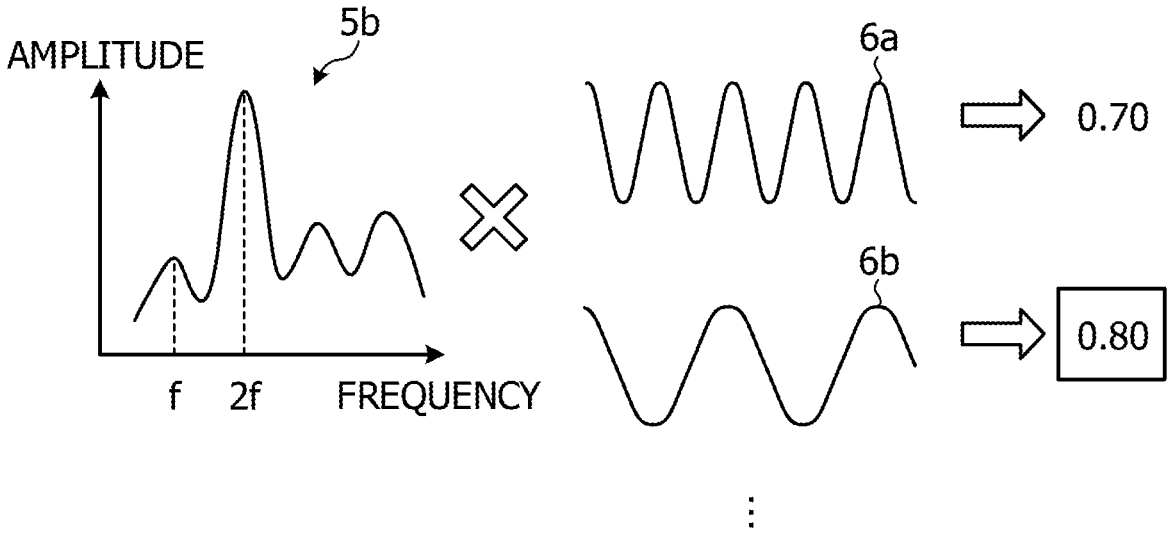
FIG. 20 is a diagram illustrating a problem of the example of the related art.

FIG. 20 is a diagram illustrating the problem of the example of the related art. In FIG. 20, an input spectrum 5*b* is output from the frequency conversion unit 10. The amplitude of the input spectrum 5*b* at the frequency f is smaller than an appropriate value due to bandwidth shaping, a surrounding environment, or the like.

The correlation calculation unit 11 calculates a correlation value of 0.70 between the input spectrum 5*b* and the cosine wave 6*a*. The correlation calculation unit 11 also calculates a correlation value of 0.80 between the input spectrum 5*b* and the cosine wave 6*b*.

The identification unit 12 compares correlation values and identifies a largest correlation value. In the example illustrated in FIG. 20, the correlation value of 0.80 is the largest value, and the identification unit 12 outputs the frequency 2*f* [Hz] associated with the correlation value of 0.80 as a pitch frequency.

Although the amplitude of the input spectrum 5*b* at the frequency f is smaller than an appropriate value, a frequency corresponding to a local maximum in a low band is f. A correct pitch frequency, therefore, is f. The pitch frequency output from the identification unit 12 is thus incorrect.

An aspect of the present disclosure aims to provide a speech processing program, a method for processing speech, and a speech processing apparatus capable of improving the accuracy of estimating a pitch frequency.

Embodiments of a speech processing program, a method for processing speech, and a speech processing apparatus disclosed in the present disclosure will be described in detail hereinafter based on the drawings. The present disclosure is not limited by the embodiments.

[First Embodiment]

Figure 1:
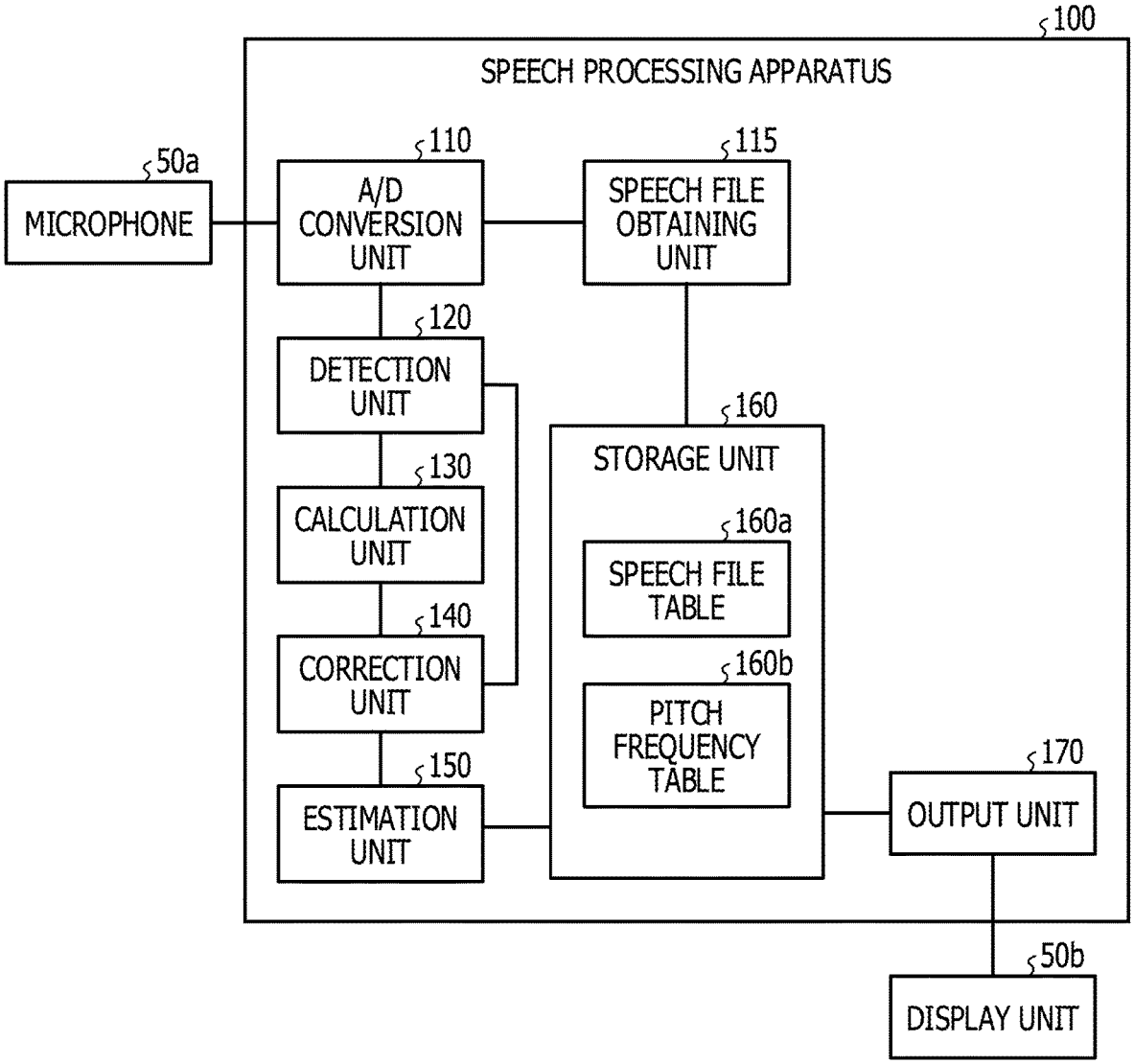
FIG. 1 is a functional block diagram illustrating the configuration of a speech processing apparatus according to a first embodiment.

FIG. 1 is a functional block diagram illustrating the configuration of a speech processing apparatus according to a first embodiment. As illustrated in FIG. 1, a speech processing apparatus 100 is connected to a microphone 50*a* and a display unit 50*b*. The speech processing apparatus 100 includes an analog-to-digital (A/D) conversion unit 110, a speech file obtaining unit 115, a detection unit 120, a calculation unit 130, a correction unit 140, an estimation unit 150, a storage unit 160, and an output unit 170.

The microphone 50*a* is a device that inputs information regarding a collected speech sound to the speech processing apparatus 100. In the following description, information regarding a speech sound input from the microphone 50*a* to the speech processing apparatus 100 will be referred to as a "speech signal". A speech signal is an example of an input speech sound.

The display unit 50*b* is a display device that displays information output from the speech processing apparatus 100. The display unit 50*b* corresponds to a liquid crystal display, a touch panel, or the like.

The A/D conversion unit 110 is a processing unit that receives a speech signal from the microphone 50*a* and that performs A/D conversion. More specifically, the ND conversion unit 110 converts a speech signal (analog signal) into a speech signal (digital signal). The A/D conversion unit 110 outputs the speech signal (digital signal) to the speech file obtaining unit 115 and the detection unit 120. In the following description, a speech signal (digital signal) output from the A/D conversion unit 110 will be simply referred to as a "speech signal".

The speech file obtaining unit 115 is a processing unit that converts a speech sound into a speech file using a certain speech file format. A speech file includes, for example, information in which time points and the strength of a speech signal are associated with each other. The speech file obtaining unit 115 stores the speech file in a speech file table 160*a* of the storage unit 160.

The detection unit 120 is a processing unit that detects a frequency spectrum from a speech signal (can also be referred to as an "input speech sound"). The detection unit 120 outputs information regarding the frequency spectrum to the calculation unit 130 and the correction unit 140. In the following description, a frequency spectrum detected from a speech signal will be referred to as an "input spectrum" (can also be referred to as a "first frequency spectrum").

The detection unit 120 performs a short-time discrete Fourier transform (STFT) on speech signals x(t-T) to x(t) corresponding to frames to detect input spectra X(l, k). The length of each frame is a predetermined length T.

The variables t, l, k, x(t), and x(l, k) will be described. t is a variable indicating time. l is a variable indicating a frame number. k is a variable indicating a band [bin] (k=0, 1, . . . . T−1). x(t) denotes an n-th speech signal. X(l, k) denotes an n-th input spectrum.

The calculation unit 130 is a processing unit that calculates a reference spectrum (can also be referred to as a "second frequency spectrum") based on an envelope of an input spectrum. The calculation unit 130 calculates a reference spectrum by, for example, smoothing an input spectrum X(l, k) in a frequency direction. The calculation unit 130 outputs information regarding the reference spectrum to the correction unit 140.

For example, the calculation unit 130 uses a Hamming window W(m) of a filter length Q in order to smooth an input spectrum X(l, k) in the frequency direction. The Hamming window W(m) is defined by expression (1). The variable m corresponds to the band [bin] at a time when the Hamming window is disposed on an input spectrum.

$$W(m) = 0.5 - 0.5\cos\left(\frac{m\pi}{\left\lceil \frac{Q}{2} \right\rceil + 1}\right) \tag{1}$$

The calculation unit 130 obtains a reference spectrum based on expression (2). Although a case in which the Hamming window is used will be described as an example, a Gaussian window or a Blackman window may be used, instead.

$$\overline{X}(l, k) = \sum_{i=1}^{Q} X\left(l, k - \left\lceil \frac{Q}{2} \right\rceil + i\right) W(i) \tag{2}$$

The correction unit 140 is a processing unit that corrects an input spectrum based on comparison between the amplitude of the input spectrum (can also be referred to as a "first amplitude") and the amplitude of a reference spectrum (can also be referred to as a "second amplitude"). In the following description, a corrected input spectrum will be referred to as a "corrected spectrum" (can also be referred to as a "third frequency spectrum"). The correction unit 140 outputs information regarding the corrected spectrum to the estimation unit 150.

Figure 2:
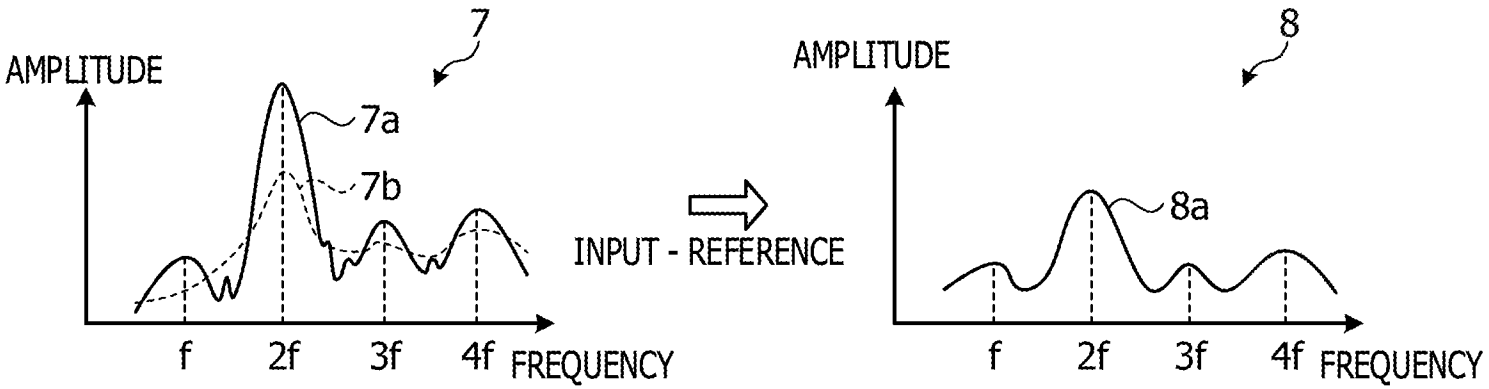
FIG. 2 is a first diagram illustrating a process performed by a correction unit according to the first embodiment.

FIG. 2 is a first diagram illustrating a process performed by the correction unit 140 according to the first embodiment. In FIG. 2, horizontal axes of graphs 7 and 8 represent frequency, and vertical axes represent the amplitude of a spectrum. The graph 7 includes an input spectrum 7*a* and a reference spectrum 7*b*.

The correction unit 140 calculates a difference D(l, k) between an input spectrum and a reference spectrum based on expression (3). In FIG. 2, a differential spectrum 8*a* is a difference between the input spectrum 7*a* and the reference spectrum 7*b*. In the differential spectrum 8*a*, a noise component included in the input spectrum 7*a* has been removed, and positions of local maxima are evident.

$$D(1,k)=X(1,k)-\overline{X}(1,k) \tag{3}$$

The correction unit 140 calculates a corrected spectrum Y(l, k) by substituting D(l, k), which indicates a differential spectrum, into expression (4). In expression (4), g(D(l, k)) is a predetermined function.

$$Y(1,k)=g(D(1,k)) \tag{4}$$

Figure 3:
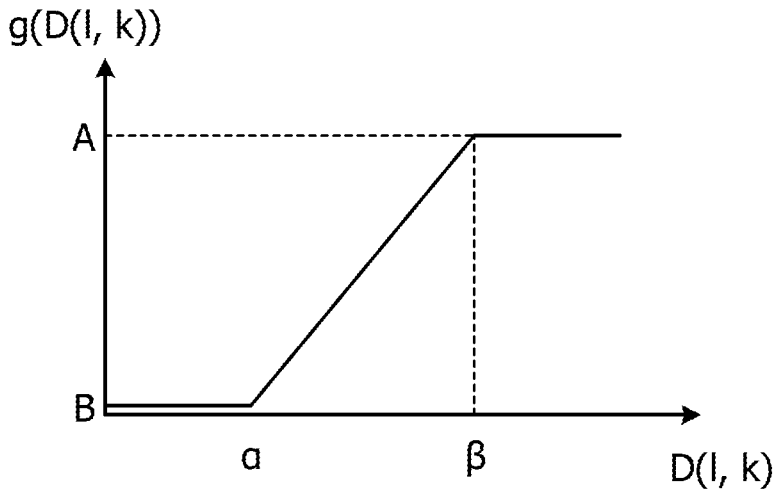
FIG. 3 is a diagram illustrating a function g(D(l, k))

FIG. 3 is a diagram illustrating a function g(D(l, k)). In a graph illustrated in FIG. 3, a horizontal axis represents D(l, k), and a vertical axis represents g(D(l, k)). As illustrated in FIG. 3, when the difference D(l, k) is smaller than α, g(D(l, k)) becomes B. When D(l, k) is larger than β, g(D(l, k)) becomes α, β, A, and B are predetermined.

Figure 4:
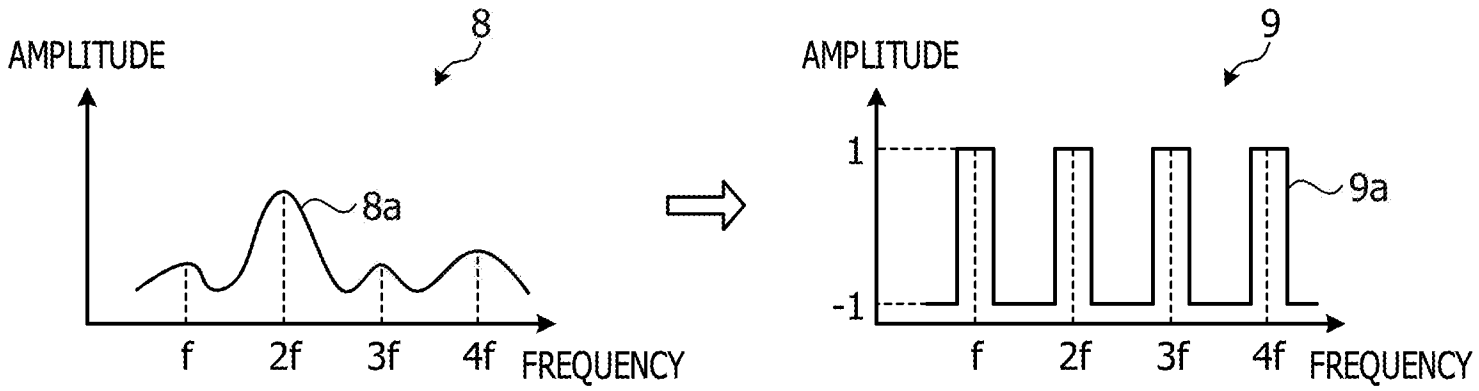
FIG. 4 is a second diagram illustrating the process performed by the correction unit according to the first embodiment.

FIG. 4 is a second diagram illustrating the process performed by the correction unit 140 according to the first embodiment. In FIG. 4, horizontal axes of graphs 8 and 9 represent frequency, and vertical axes represent the amplitude of a spectrum. The graph 8 includes a differential spectrum 8*a*. The correction unit 140 calculates a corrected spectrum 9*a* based on the differential spectrum 8*a* and expression (4). The corrected spectrum 9*a* varying from −1 to 1 is obtained, for example, by determining A as 1 and B as −1 for expression (4) and making α and β close to each other. Although A is 1 and B is −1 here as an example, A and B are not limited to these values. For example, A may be 1, and B may be −0.5.

As illustrated in FIG. 4, the corrected spectrum 9*a* becomes 1 at frequencies f, 2*f*, 3*f*, and 4*f* corresponding to local maxima of the differential spectrum 8.

Returning to FIG. 1, the estimation unit 150 is a processing unit that estimates a pitch frequency of a speech signal based on correlation between a corrected spectrum and periodic signals corresponding to frequencies in certain bands. The estimation unit 150 stores information regarding the pitch frequency in, for example, a pitch frequency table 160*b*.

Expression (5) indicates periodic signals used by the estimation unit 150. Although cosine waves are used as periodic signals here, periodic signals other than cosine waves may be used, instead. In expression (5), a variable p is a≤p≤b. a and b are predetermined values corresponding to, for example, the number of bins in 50 to 1,000 Hz.

$$S(p,k)=\cos(2*\pi k/p) \tag{5}$$

The estimation unit 150 calculates correlation values C(p) between the corrected spectrum Y(l, k) and periodic signals S(p, k) based on expression (6). The estimation unit 150 calculates the correlation values C(p) corresponding to p while changing p from a to b.

$$C(p) = \sum_{k=0}^{T-1} Y(l, k)S(p, k) \tag{6}$$

The estimation unit 150 calculates a maximum value M based on expression (7). The estimation unit 150 estimates, as a pitch frequency P, a value of p with which the maximum value M is obtained. When the maximum value M is equal to or larger than a threshold TH, the estimation unit 150 outputs the pitch frequency P. When the maximum value M is smaller than the threshold TH, the estimation unit 150 outputs the pitch frequency P as 0.

$$M=\max(C(p), a\le p\le b) \tag{7}$$

The estimation unit 150 repeatedly performs the above process for each frame, associates frame numbers and pitch frequencies with each other, and registers the frame numbers and the pitch frequencies to the pitch frequency table 160*b*.

The storage unit 160 includes the speech file table 160*a* and the pitch frequency table 160*b*. The storage unit 160 corresponds to a semiconductor memory such as a random-access memory (RAM), a read-only memory (ROM), or a flash memory or a storage device such as a hard disk drive (HDD).

The speech file table 160*a* holds speech files output from the speech file obtaining unit 115.

The pitch frequency table 160*b* holds information regarding pitch frequencies output from the estimation unit 150. The pitch frequency table 160*b* associates, for example, frame numbers and pitch frequencies with each other.

The output unit 170 is a processing unit that outputs screen information regarding pitch frequencies to the display unit 50*b* to display the screen information on the display unit 50*b*.

Figure 5:
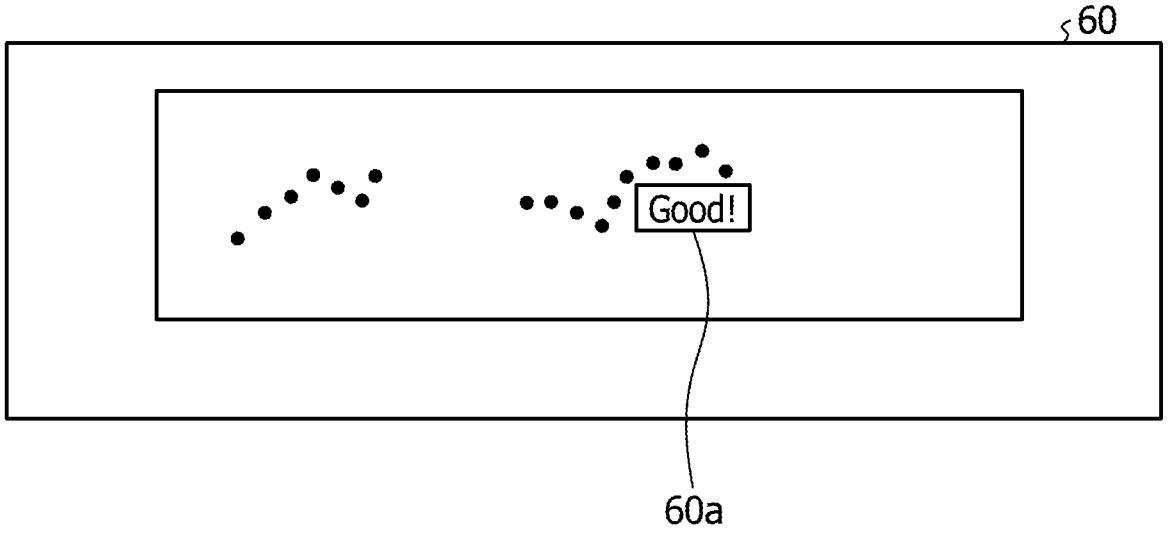
FIG. 5 is a diagram illustrating an example of screen information displayed on a display unit.

FIG. 5 is a diagram illustrating an example of screen information displayed on the display unit 50*b*. The output unit 170 displays pitch frequencies on screen information 60 in order of estimation performed by the estimation unit 150. The output unit 170 records a dot at a higher position, for example, as the pitch frequency becomes higher. When the pitch frequency is 0, the estimation unit 150 does not record a dot.

Alternatively, the output unit 170 may evaluate a speech signal based on a plurality of pitch frequencies stored in the pitch frequency table 160*b* and display a result of the evaluation on the screen information 60. If a difference between two selected pitch frequencies is equal to or larger than a threshold, for example, it indicates that corresponding speech has a pleasant lilt, and the output unit 170 sets a result 60*a* of evaluation, namely "Good!", to the screen information 60. The output unit 170 may also perform evaluation based on a table (not illustrated) in which characteristics of changes in the pitch frequency and results of evaluation.

The A/D conversion unit 110, the speech file obtaining unit 115, the detection unit 120, the calculation unit 130, the correction unit 140, the estimation unit 150, and the output unit 170 illustrated in FIG. 1 correspond to a control unit. The control unit is achieved by a central processing unit (CPU), a microprocessor unit (MPU), or the like. The control unit may be achieved by a hardwired logic circuit such as an application-specific integrated circuit (ASIC) or a field-programmable gate array (FPGA), instead.

Figure 6:
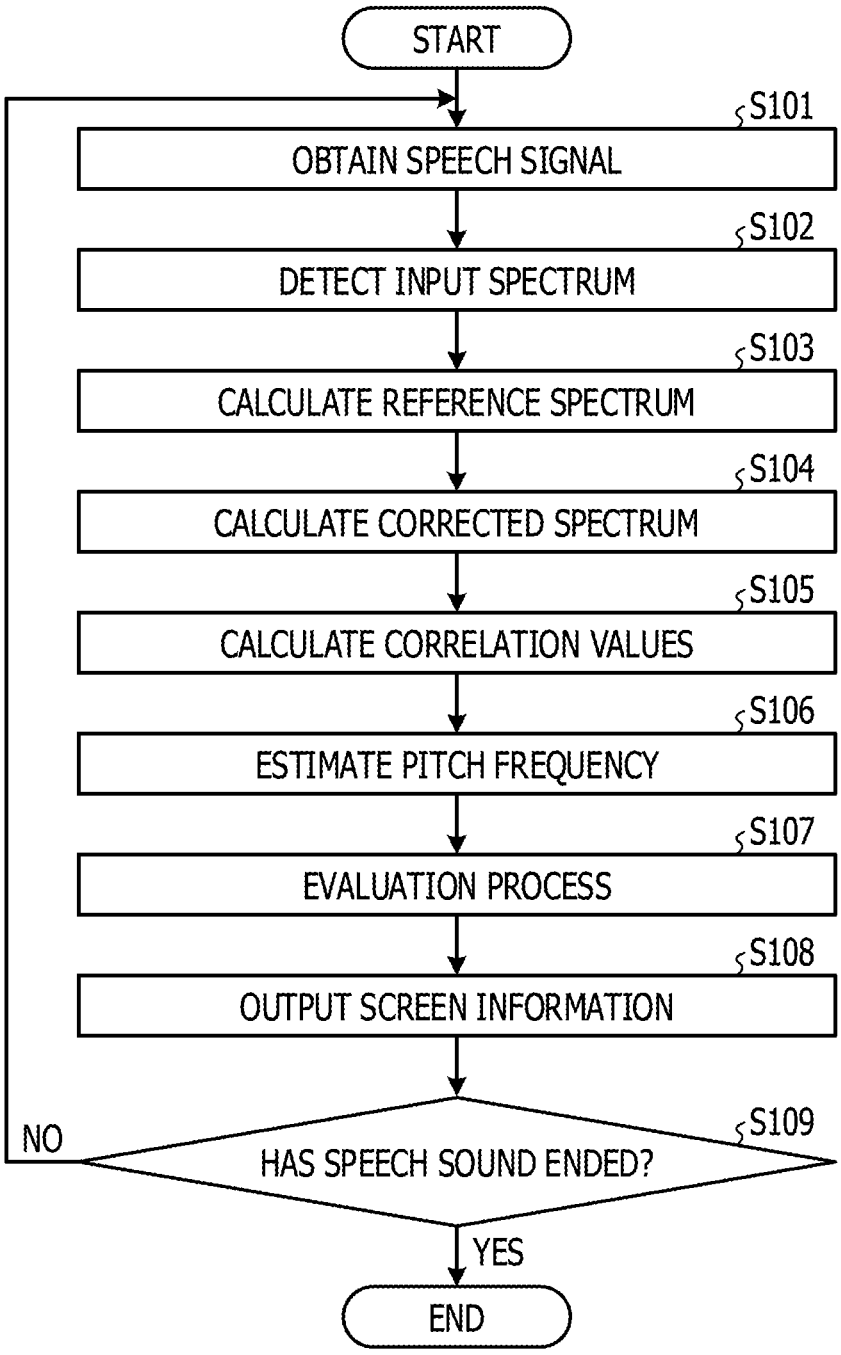
FIG. 6 is a flowchart illustrating a processing procedure used by the speech processing apparatus according to the first embodiment.

Next, an example of a processing procedure used by the speech processing apparatus 100 according to the first embodiment will be described. FIG. 6 is a flowchart illustrating the processing procedure used by the speech processing apparatus 100 according to the first embodiment. As illustrated in FIG. 6, the A/D conversion unit 110 of the speech processing apparatus 100 receives a speech signal from the microphone 50*a* (step S101). The detection unit 120 of the speech processing apparatus 100 detects an input spectrum based on the speech signal (step S102).

The calculation unit 130 of the speech processing apparatus 100 calculates a reference spectrum (step S103). The correction unit 140 of the speech processing apparatus 100 corrects the input spectrum to calculate a corrected spectrum (step S104).

The estimation unit 150 of the speech processing apparatus 100 calculates correlation values between the corrected spectrum and periodic signals corresponding to frequencies in certain bands (step S105). The estimation unit 150 estimates a pitch frequency at which a maximum value of the correlation values is obtained based on the correlation values (step S106).

The output unit 170 of the speech processing apparatus 100 evaluates the speech signal based on pitch frequencies (step S107). The output unit 170 generates screen information and outputs the screen information to the display unit 50*b* (step S108).

The speech processing apparatus 100 determines whether a speech sound has ended (step S109). If the speech sound has not ended (NO in step S109), the speech processing apparatus 100 returns to step S101. If the speech sound has not ended (YES in step S109), on the other hand, the speech processing apparatus 100 ends the process.

Next, advantageous effects produced by the speech processing apparatus 100 according to the first embodiment will be described. The speech processing apparatus 100 calculates a reference spectrum based on an envelope of an input spectrum of a speech signal and calculates a corrected spectrum by comparing the input spectrum and the reference spectrum. The speech processing apparatus 100 estimates a pitch frequency of the speech signal based on correlation values between the corrected spectrum and periodic signals corresponding to frequencies in certain bands. Since the corrected spectrum indicates local maxima of the input spectrum with the same amplitude, decreases in the input spectrum or some harmonics do not affect the correlation values, insofar as the local maxima are maintained. As a result, the accuracy of estimating a pitch frequency improves.

Figure 7:
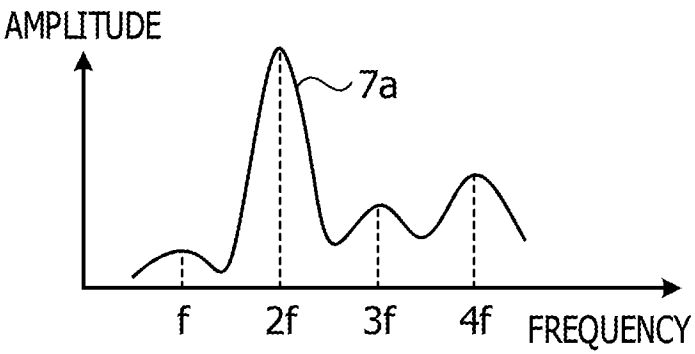
FIG. 7 is a diagram illustrating advantageous effects produced by the speech processing apparatus according to the first embodiment.
Figure 7:
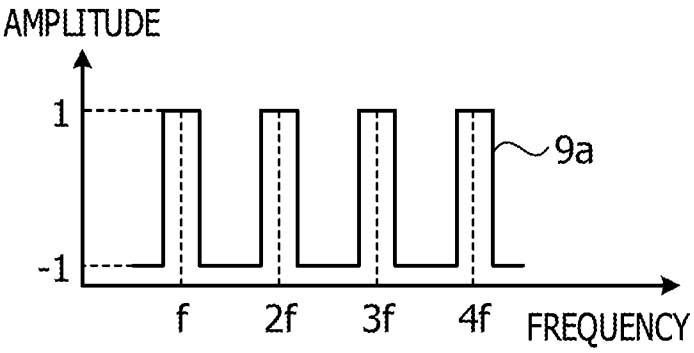

FIG. 7 is a diagram illustrating the advantageous effects produced by the speech processing apparatus 100 according to the first embodiment. In the example of the related art illustrated in FIG. 7, a pitch frequency is estimated by directly calculating correlation values between the input spectrum 7*a* and the periodic signals. If the input spectrum 7*a* decreases in a low band (for example, a frequency f), therefore, an appropriate correlation value is not calculated, and it is difficult to obtain an appropriate pitch frequency. In the example illustrated in FIG. 7, a correlation value between the frequency f [Hz] and the input spectrum 7*a* is 0.7, and a correlation value between a frequency 2*f* [Hz] and the input spectrum 7*a* is 0.8. A correct pitch frequency is f [Hz], but since a largest correlation value is 0.8, which corresponds to 2*f* [Hz], the pitch frequency is incorrectly determined as 2*f* [Hz] in the example of the related art.

The speech processing apparatus 100 according to the first embodiment, on the other hand, corrects the input spectrum 7*a* to calculate the corrected spectrum 9*a* and estimates a pitch frequency by calculating correlation values between the corrected spectrum 9*a* and the periodic signals. The corrected spectrum 9*a* indicates local maxima with the same amplitude even if there are decreases in input spectrum 7*a* or some harmonics. It is therefore possible to appropriately obtain the pitch frequency even if there are decreases in the input spectrum 7*a* or some harmonics, insofar as the local maxima are maintained. In the example illustrated in FIG. 7, a correlation value between the frequency f [Hz] and the corrected spectrum 9*a* is 0.9, and a correlation value between the frequency 2*f* [Hz] and the corrected spectrum 9*a* is 0.7. The speech processing apparatus 100, therefore, determines the pitch frequency as f [Hz].

Although the calculation unit 130 of the speech processing apparatus 100 according to the first embodiment calculates a reference spectrum by smoothing an input spectrum in the frequency direction, a reference spectrum may be calculated by another process, instead.

Figure 8:
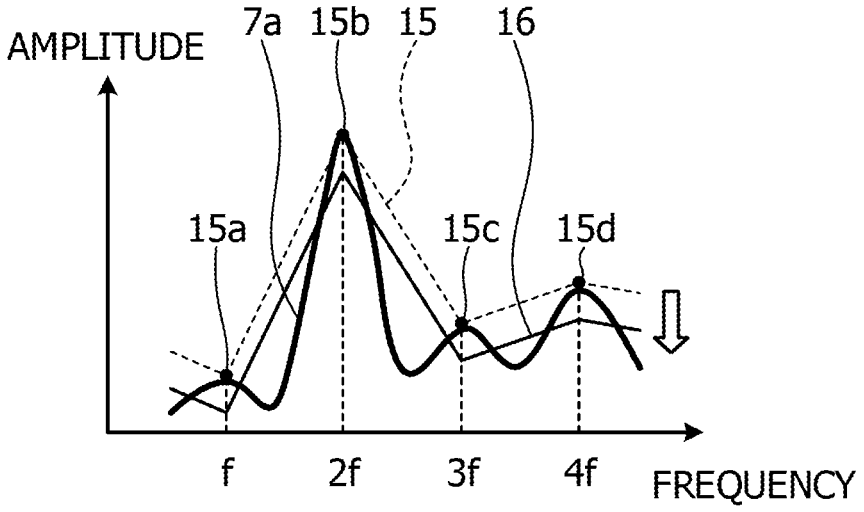
FIG. 8 is a first diagram illustrating another process for calculating a reference spectrum.

FIG. 8 is a first diagram illustrating another process for calculating a reference spectrum. The calculation unit 130 identifies local maxima by obtaining derivatives of the input spectrum 7*a*. For example, the calculation unit 130 calculates points at which the derivative of the input spectrum 7*a* begins to decrease as local maxima. For example, the calculation unit 130 calculates local maxima 15*a* to 15*d* from the input spectrum 7*a*. The calculation unit 130 obtains a spectrum 15 by connecting the local maxima 15*a* to 15*d* to one another. The calculation unit 130 calculates a reference spectrum 16 by translating the spectrum 15 downward.

The calculation unit 130 may calculate a reference spectrum using a process other than that illustrated in FIG. 8. For example, the calculation unit 130 may calculate an envelope of an input spectrum and calculate a reference spectrum by translating the calculated envelope downward. When calculating an envelope, the calculation unit 130 conducts a linear predictive coding (LPC) analysis, a cepstrum analysis, or the like.

[Second Embodiment]

Figure 9:
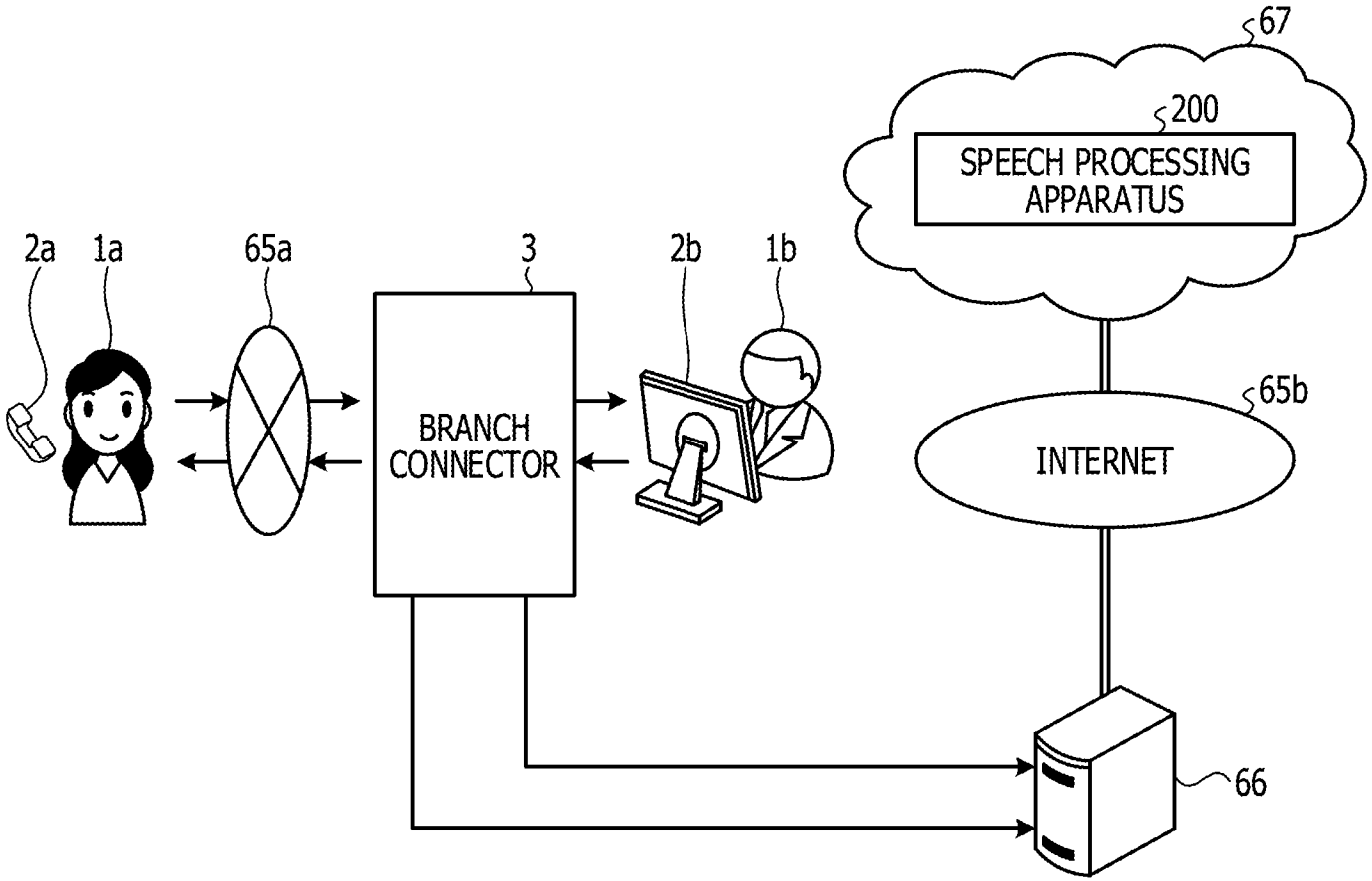
FIG. 9 is a diagram illustrating the configuration of a speech processing system according to a second embodiment.

FIG. 9 is a diagram illustrating the configuration of a speech processing system according to a second embodiment. As illustrated in FIG. 9, the speech processing system includes a mobile terminal 2*a*, a terminal apparatus 2*b*, a branch connector 3, a recording apparatus 66, and a cloud 67. The mobile terminal 2*a* is connected to the branch connector 3 through a telephone network 65*a*. The terminal apparatus 2*b* is connected to the branch connector 3. The branch connector 3 is connected to the recording apparatus 66. The recording apparatus 66 is connected to the cloud 67 through the Internet 65*b*. The cloud 67 includes, for example, a speech processing apparatus 200. Although not illustrated, the speech processing apparatus 200 may include a plurality of servers. The mobile terminal 2*a* and the terminal apparatus 2*b* are connected to microphones (not illustrated).

A speech sound uttered by a speaker 1*a* is collected by the microphone of the mobile terminal 2*a*, and an obtained speech signal is transmitted to the recording apparatus 66 through the branch connector 3. In the following description, a speech signal of the speaker la will be referred to as a "first speech signal".

A speech sound uttered by a speaker 1*b* is collected by the microphone of the terminal apparatus 2*b*, and an obtained speech signal is transmitted to the recording apparatus 66 through the branch connector 3. In the following description, a speech signal of the speaker 1*b* will be referred to as a "second speech signal".

The recording apparatus 66 records the first and second speech signals. Upon receiving the first speech signal, for example, the recording apparatus 66 converts the first speech signal into a speech file using a certain speech file format and transmits the speech file of the first speech signal to the speech processing apparatus 200. In the following description, a speech file of a first speech signal will also be referred to as a "first speech file".

Upon receiving the second speech signal, the recording apparatus 66 converts the second speech signal into a speech file using a certain speech file format and transmits the speech file of the second speech signal to the speech processing apparatus 200. In the following description, a speech file of a second speech signal will also be referred to as a "second speech file".

The speech processing apparatus 200 estimates a pitch frequency of a first speech signal of a first speech file. The speech processing apparatus 200 also estimates a pitch frequency of a second speech signal of a second speech file. Because a process for estimating a pitch frequency of a first speech signal and a process for estimating a pitch frequency of a second speech signal are the same, the process for estimating a pitch frequency of a first speech signal will be described hereinafter. The first and second speech signals will be generically referred to as "speech signals" in the following description.

Figure 10:
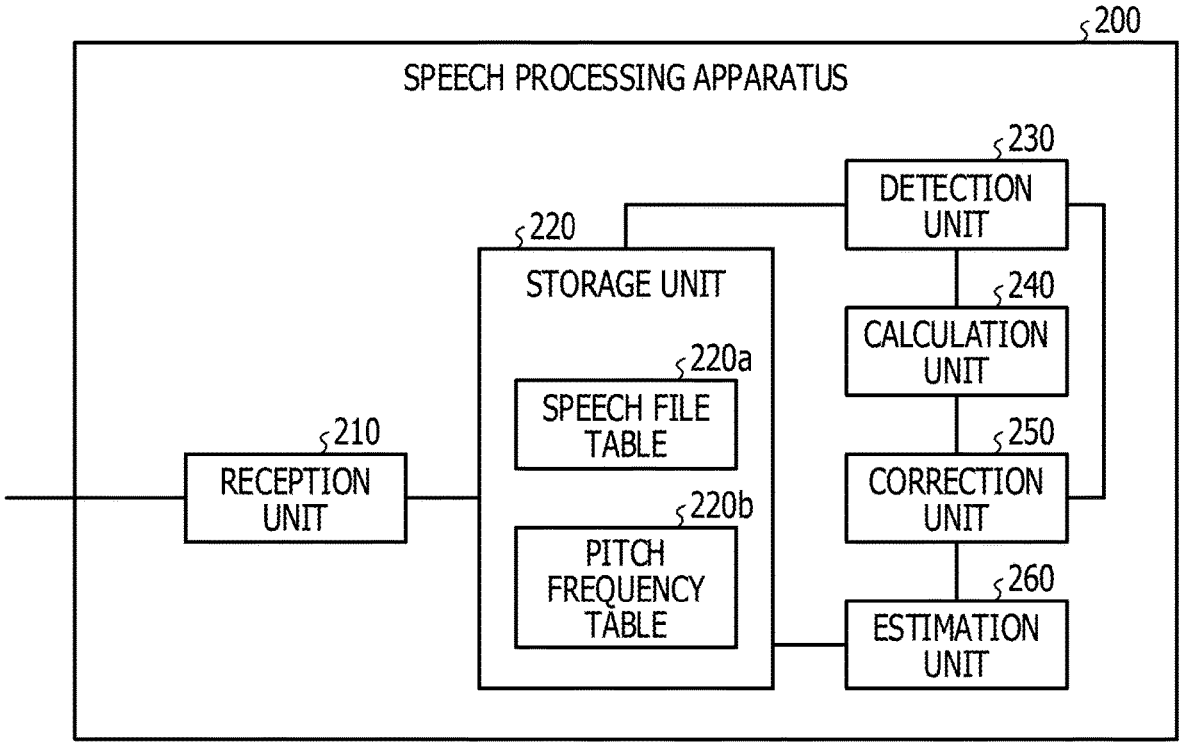
FIG. 10 is a functional block diagram illustrating the configuration of a speech processing apparatus according to the second embodiment.

FIG. 10 is a functional block diagram illustrating the configuration of the speech processing apparatus 200 according to the second embodiment. As illustrated in FIG. 10, the speech processing apparatus 200 includes a reception unit 210, a storage unit 220, a detection unit 230, a calculation unit 240, a correction unit 250, and an estimation unit 260.

The reception unit 210 is a processing unit that receives a speech file from the recording apparatus 66. The reception unit 210 registers the received speech file to a speech file table 220*a* of the storage unit 220. The reception unit 210 corresponds to a communication device.

The storage unit 220 includes the speech file table 220*a* and a pitch frequency table 220*b*. The storage unit 220 corresponds to a semiconductor memory such as a RAM, a ROM, or a flash memory or a storage device such as an HDD.

The detection unit 230 is a processing unit that obtains a speech file (speech signal) from the speech file table 220*a* and that detects an input spectrum (frequency spectrum) from the obtained speech signal. The detection unit 230 outputs information regarding the detected input spectrum to the calculation unit 240 and the correction unit 250. A process for detecting an input spectrum from a speech signal performed by the detection unit 230 is the same as that performed by the detection unit 120 according to the first embodiment.

The calculation unit 240 is a processing unit that calculates a reference spectrum based on an envelope of an input spectrum. The calculation unit 240 outputs information regarding the reference spectrum to the correction unit 250. A process for calculating a reference spectrum based on an input spectrum is the same as that performed by the calculation unit 130 according to the first embodiment.

The correction unit 250 is a processing unit that corrects an input spectrum based on comparison between the amplitude of the input spectrum and the amplitude of a reference spectrum. A process for correcting an input spectrum and calculating a corrected spectrum performed by the correction unit 250 is the same as that performed by the correction unit 140 according to the first embodiment. The correction unit 250 outputs information regarding a corrected spectrum to the estimation unit 260.

The estimation unit 260 is a processing unit that estimates a pitch frequency of a speech signal based on correlation between a corrected spectrum and periodic signals corresponding to frequencies in certain bands. The estimation unit 260 calculates correlation values C(p) between the corrected spectrum and the periodic signals and identifies a frequency p at which a maximum value M of the correlation values C(p) is obtained in the same manner as the estimation unit 150 according to the first embodiment. In the following description, the frequency p at which the maximum value M of the correlation values C(p) is obtained will be denoted by P.

Furthermore, if the following first and second conditions are satisfied, the estimation unit 260 determines the frequency P as the pitch frequency. If either the first condition or the second condition is not satisfied, on the other hand, the estimation unit 260 outputs the pitch frequency as 0. X(l, P) in the second condition denotes the amplitude of an input spectrum whose frame number is "l", which is a current analysis target, at the frequency P.

First condition: The maximum value M be equal to or larger than a threshold TH1.

Second condition: X(l, P), X(l, 2P), and X(l, 3P) be equal to or larger than a threshold TH2.

The estimation unit 260 associates the frame number and the pitch frequency with each other and registers the frame number and the pitch frequency to the pitch frequency table 220*b*.

The detection unit 230, the calculation unit 240, the correction unit 250, and the estimation unit 260 repeatedly perform the above process while updating a position at which a speech file is analyzed. If a current analysis start position is denoted by u, for example, a next analysis start position is u+T. T denotes a predetermined length of each frame.

Figure 11:
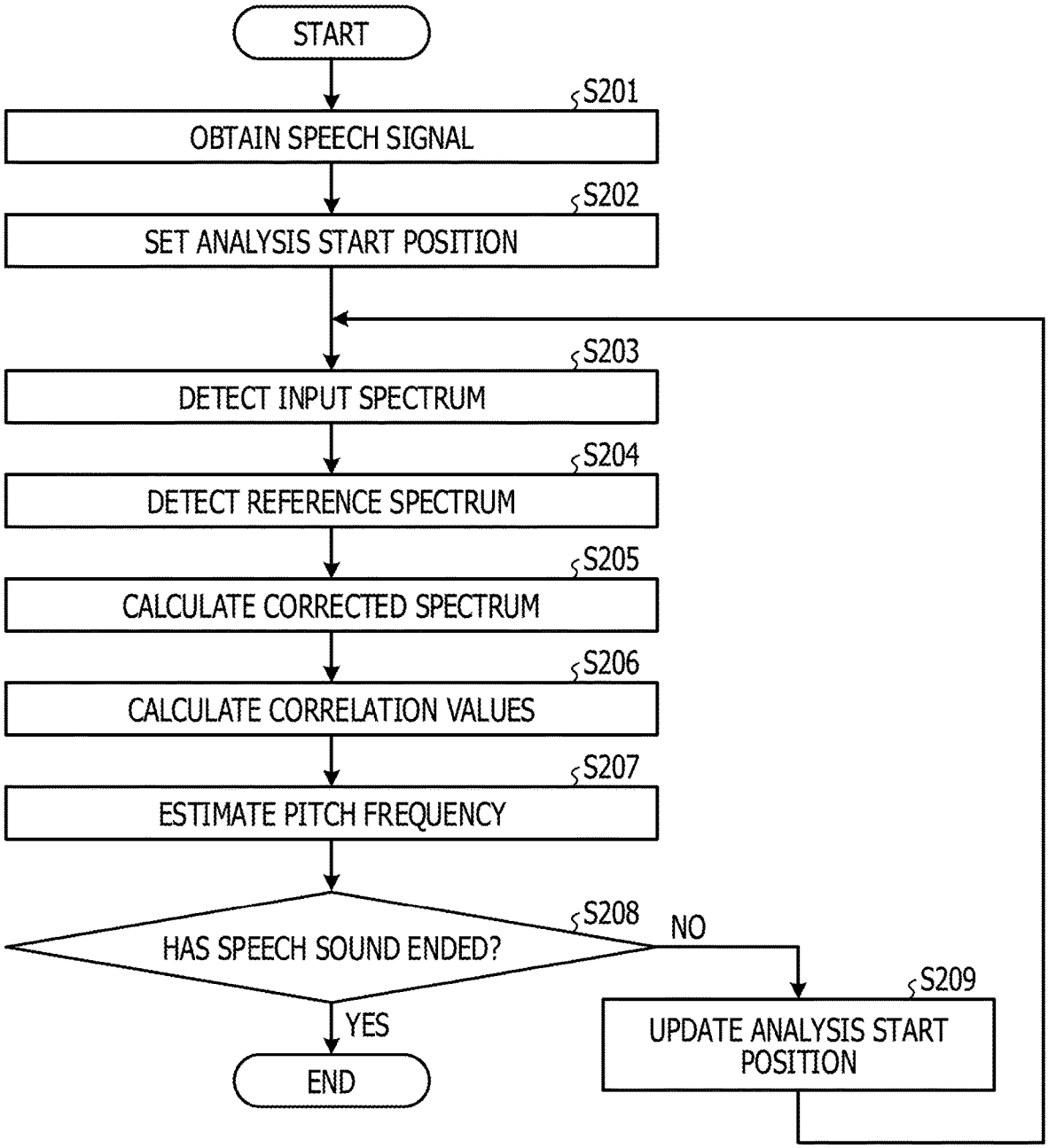
FIG. 11 is a flowchart illustrating a processing procedure used by the speech processing apparatus according to the second embodiment.

Next, an example of a processing procedure used by the speech processing apparatus 200 according to the second embodiment will be described. FIG. 11 is a flowchart illustrating the processing procedure used by the speech processing apparatus 200 according to the second embodiment. As illustrated in FIG. 11, the detection unit 230 of the speech processing apparatus 200 obtains a speech signal (speech file) from the speech file table 220*a* (step S201). The speech processing apparatus 200 sets an analysis start position (step S202).

The detection unit 230 detects an input spectrum (step S203). The calculation unit 240 of the speech processing apparatus 200 calculates a reference spectrum (step S204). The correction unit 250 of the speech processing apparatus 200 corrects an input spectrum to calculate a corrected spectrum (step S205).

The estimation unit 260 of the speech processing apparatus 200 calculates correlation values between the corrected spectrum and periodic signals corresponding to frequencies in certain bands (step S206). The estimation unit 260 estimates a pitch frequency at which a maximum value of the correlation values is obtained based on the correlation values (step S207). If the first and second conditions are satisfied in step S207, the estimation unit 260 estimates the frequency at which the maximum value of the correlation values is obtained as the pitch frequency.

The speech processing apparatus 200 determines whether a speech sound has ended (step S208). If the speech sound has not ended (NO in step S208), the speech processing apparatus 200 updates the analysis start position (step S209) and returns to step S203. If the speech sound has ended (YES in step S208), on the other hand, the speech processing apparatus 200 ends the process.

Next, advantageous effects produced by the speech processing apparatus 200 according to the second embodiment will be described. The speech processing apparatus 200 estimates a pitch frequency of a speech signal based on correlation values between a corrected spectrum and periodic signals corresponding to frequencies in certain bands. Since the corrected spectrum indicates local maxima of the input spectrum with the same amplitude, decreases in the input spectrum or some harmonics do not affect the correlation values, insofar as the local maxima are maintained. As a result, the accuracy of estimating a pitch frequency improves.

In addition, the speech processing apparatus 200 corrects a pitch frequency based on the amplitude of an input spectrum corresponding to integral multiples of the pitch frequency. If X(l, P), X(l, 2P), and X(l, 3P) are equal to or larger than the threshold TH2, for example, a position of the pitch frequency P in the input spectrum corresponds to a position of a local maximum, and the pitch frequency P is appropriate. The pitch frequency P, therefore, is output as it is. If X(l, P), X(l, 2P), and X(l, 3P) are smaller than the threshold TH2, on the other hand, the position of the pitch frequency P is deviated from a position of a local maximum, and the pitch frequency P is not appropriate. The above process, therefore, is performed, and only pitch frequencies that have been determined to be appropriate are output. 0 may be output for other pitch frequencies.

[Third Embodiment]

Figure 12:
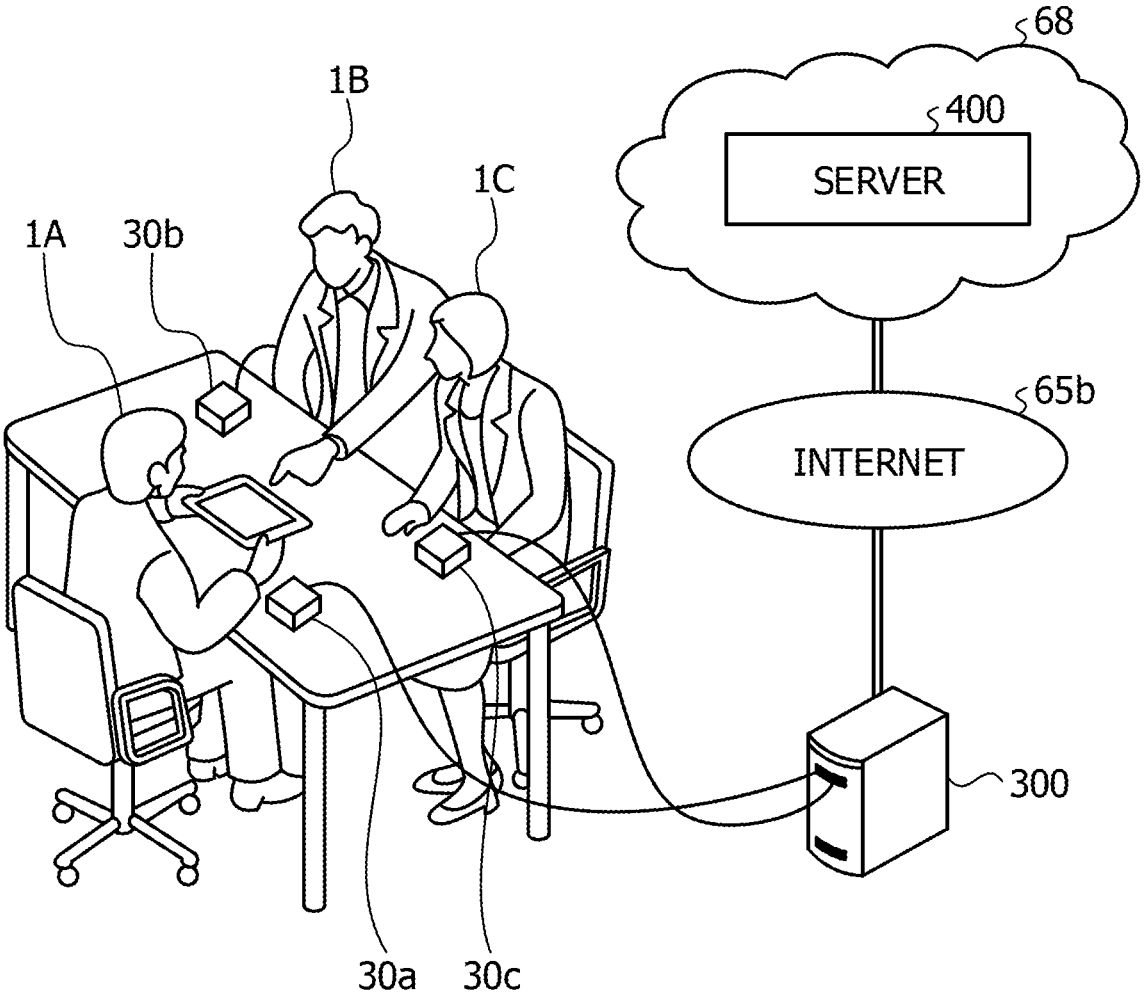
FIG. 12 is a diagram illustrating the configuration of a speech processing system according to a third embodiment.

FIG. 12 is a diagram illustrating the configuration of a speech processing system according to a third embodiment. As illustrated in FIG. 12, the speech processing system includes microphones 30*a* to 30*c*, a speech processing apparatus 300, and a cloud 68. The microphones 30*a* to 30*c* are connected to the speech processing apparatus 300. The speech processing apparatus 300 is connected to the cloud 68 through the Internet 65*b*. The cloud 68 includes, for example, a server 400.

A speech sound uttered by a speaker 1A is collected by the microphone 30*a*, and an obtained speech signal is output to the speech processing apparatus 300. A speech sound uttered by a speaker 1B is collected by the microphone 30*b*, and an obtained speech signal is output to the speech processing apparatus 300. A speech sound uttered by a speaker 1C is collected by the microphone 30*c*, and an obtained speech signal is output to the speech processing apparatus 300.

In the following description, a speech signal of the speaker 1A will be referred to as a "first speech signal". A speech signal of the speaker 1B will be referred to as a "second speech signal". A speech signal of the speaker 1C will be referred to as a "third speech signal".

Speaker information regarding the speaker 1A, for example, is added to the first speech signal. Speaker information is information for uniquely identifying a speaker. Speaker information regarding the speaker 1B is added to the second speech signal. Speaker information regarding the speaker 1C is added to the third speech signal.

The speech processing apparatus 300 records the first to third speech signals. The speech processing apparatus 300 also performs a process for detecting pitch frequencies of the speech signals. The speech processing apparatus 300 associates the speaker information and a pitch frequency in each certain frame with each other and transmits the speaker information and the pitch frequency to the server 400.

The server 400 stores the pitch frequencies of the speaker information received from the speech processing apparatus 300.

Figure 13:
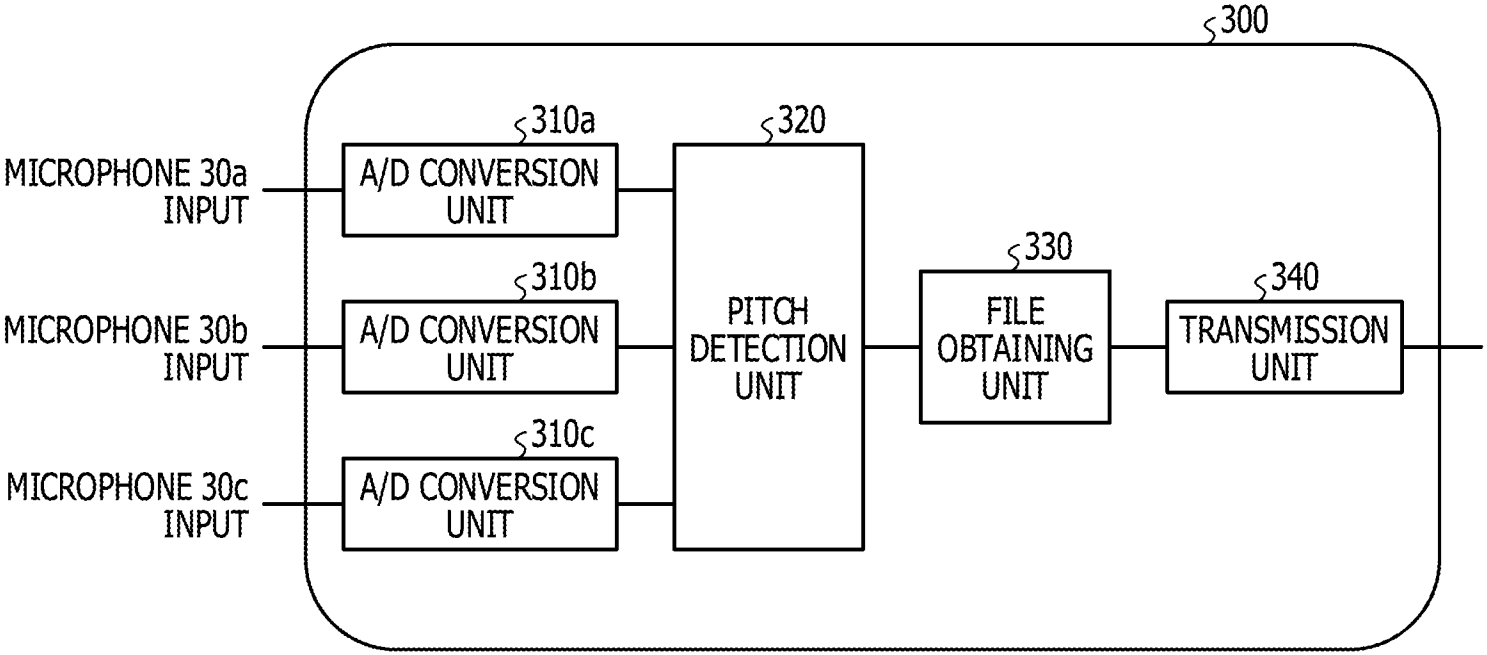
FIG. 13 is a functional block diagram illustrating the configuration of a speech processing apparatus according to the third embodiment.

FIG. 13 is a functional block diagram illustrating the configuration of the speech processing apparatus 300 according to the third embodiment. As illustrated in FIG. 13, the speech processing apparatus 300 includes A/D conversion units 310*a* to 310*c*, a pitch detection unit 320, a file obtaining unit 330, and a transmission unit 340.

The A/D conversion unit 310*a* is a processing unit that receives a first speech signal from the microphone 30*a* and that performs A/D conversion. More specifically, the A/D conversion unit 310*a* converts a first speech signal (analog signal) into a first speech signal (digital signal). The A/D conversion unit 310*a* outputs the first speech signal (digital signal) to the pitch detection unit 320. In the following description, the first speech signal (digital signal) output from the A/D conversion unit 310*a* will be simply referred to as a "first speech signal".

The A/D conversion unit 310*b* is a processing unit that receives a second speech signal from the microphone 30*b* and that performs ND conversion. More specifically, the A/D conversion unit 310*b* converts a second speech signal (analog signal) into a second speech signal (digital signal). The A/D conversion unit 310*b* outputs the second speech signal (digital signal) to the pitch detection unit 320. In the following description, the second speech signal (digital signal) output from the A/D conversion unit 310*b* will be simply referred to as a "second speech signal".

The A/D conversion unit 310*c* is a processing unit that receives a third speech signal from the microphone 30*c* and that performs A/D conversion. More specifically, the A/D conversion unit 310*c* converts a third speech signal (analog signal) into a third speech signal (digital signal). The A/D conversion unit 310*c* outputs the third speech signal (digital signal) to the pitch detection unit 320. In the following description, the third speech signal (digital signal) output from the A/D conversion unit 310*c* will be simply referred to as a "third speech signal".

The pitch detection unit 320 is a processing unit that calculates a pitch frequency in each certain frame by conducting a frequency analysis on a speech signal. For example, the pitch detection unit 320 conducts a frequency analysis on a first speech signal to detect a first pitch frequency of the first speech signal. The pitch detection unit 320 conducts a frequency analysis on a second speech signal to detect a second pitch frequency of the second speech signal. The pitch detection unit 320 conducts a frequency analysis on a third speech signal to detect a third pitch frequency of the third speech signal.

The pitch detection unit 320 associates the speaker information regarding the speaker 1A and the first pitch frequency in each certain frame with each other and outputs the speaker information and the first pitch frequency to the file obtaining unit 330. The pitch detection unit 320 associates the speaker information regarding the speaker 1B and the second pitch frequency in each certain frame with each other and outputs the speaker information and the second pitch frequency to the file obtaining unit 330. The pitch detection unit 320 associates the speaker information regarding the speaker 1C and the third pitch frequency in each certain frame with each other and outputs the speaker information and the third pitch frequency to the file obtaining unit 330.

The file obtaining unit 330 is a processing unit that generates speech file information by converting information received from the pitch detection unit 320 into a file. The speech file information includes information in which speaker information and a pitch frequency in each certain frame are associated with each other. More specifically, the speech file information includes the speaker information regarding the speaker 1A and the first pitch frequency in each certain frame are associated with each other. The speech file information includes the speaker information regarding the speaker 1B and the second pitch frequency in each certain frame are associated with each other. The speech file information includes the speaker information regarding the speaker 1C and the third pitch frequency in each certain frame are associated with each other. The file obtaining unit 330 outputs the speech file information to the transmission unit 340.

The transmission unit 340 obtains the speech file information from the file obtaining unit 330 and transmits the obtained speech file information to the server 400.

Figure 14:
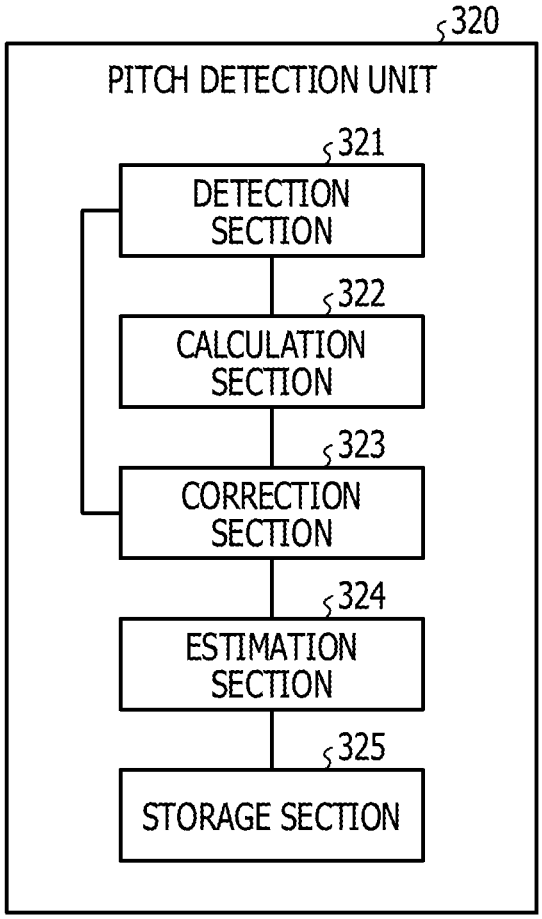
FIG. 14 is a functional block diagram illustrating the configuration of a pitch detection unit.

Next, the configuration of the pitch detection unit 320 illustrated in FIG. 13 will be described. FIG. 14 is a functional block diagram illustrating the configuration of the pitch detection unit 320. As illustrated in FIG. 14, the pitch detection unit 320 includes a detection section 321, a calculation section 322, a correction section 323, an estimation section 324, and a storage section 325. In the following description, a process for estimating a pitch frequency of the first speech signal performed by the pitch detection unit 320 will be described. Processes for estimating pitch frequencies of the second and third speech signals are the same as that for estimating a pitch frequency of the first speech signal. In the following description, the first speech signal will be simply referred to as a "speech signal" for the sake of convenience.

The detection section 321 is a processing section that obtains a speech signal and that detects an input spectrum (frequency spectrum) from the obtained speech signal. The detection section 321 outputs information regarding the detected input spectrum to the calculation section 322 and the correction section 323. A process for detecting an input spectrum from a speech signal performed by the detection section 321 is the same as that performed by the detection unit 120 according to the first embodiment.

The calculation section 322 is a processing section that calculates a reference spectrum based on an envelope of an input spectrum. The calculation section 322 outputs information regarding a reference spectrum to the correction section 323. A process for calculating a reference spectrum based on an input spectrum performed by the calculation section 322 may be the same as that performed by the calculation unit 130 according to the first embodiment, or a reference spectrum may be calculated by performing the following process.

Figure 15:
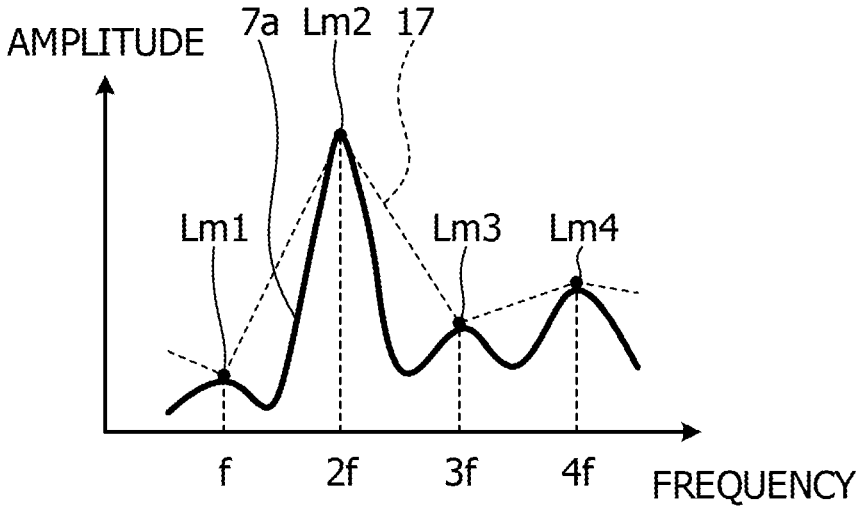
FIG. 15 is a second diagram illustrating another process for calculating a reference spectrum.

FIG. 15 is a second diagram illustrating another process for calculating a reference spectrum. The calculation section 322 calculates inclinations at k of the input spectrum X(l, k) and calculates points at which the inclination changes from positive to negative as local maxima Lm1 to Lm4. Illustration of local maxima other than the local maxima Lm1 to Lm4 is omitted.

The calculation section 322 calculates an ensemble mean AVE of the input spectrum X(l, k) based on expression (8).

$$AVE = \frac{1}{T}\sum_{k=0}^{T-1} X(l, k) \tag{8}$$

The calculation section 322 selects only local maxima larger than the ensemble average AVE and calculates a spectrum 17 by performing linear interpolation on the selected local maxima. It is assumed, for example, that the local maxima Lm1 to Lm4 are larger than the ensemble mean AVE. The calculation section 322 calculates a reference spectrum by translating an envelope of the spectrum 17 by −J1 [dB] in an amplitude direction.

The correction section 323 is a processing unit that corrects an input spectrum based on comparison between the amplitude of the input spectrum and the amplitude of a reference spectrum. A process for correcting an input spectrum and calculating a corrected spectrum performed by the correction section 323 is the same as that performed by the correction unit 140 according to the first embodiment. The correction section 323 outputs information regarding the corrected spectrum to the estimation section 324.

The estimation section 324 is a processing unit that estimates a pitch frequency of a speech signal based on correlation between a corrected spectrum and periodic signal corresponding to frequencies in certain bands. The estimation section 324 calculates correlation values C(p) between a corrected spectrum and periodic signals and identifies a frequency p at which a maximum value M of the correlation values C(p) is obtained in the same manner as the estimation unit 150 according to the first embodiment. In the following description, the frequency p at which the maximum value M of the correlation values C(p) is obtained will be denoted by P.

Furthermore, if the following third and fourth conditions are satisfied, the estimation section 324 determines the frequency P as the pitch frequency. If either the third condition or the fourth condition is not satisfied, on the other hand, the estimation section 324 outputs the pitch frequency as 0.

Third condition: The maximum value M be equal to or larger than the threshold TH1.

Fourth condition: Any of differences (P−P1, P−P2, . . . , and P−Pq) between a plurality of pitch frequencies (P1, P2, . . . , and Pq) estimated in a certain period (for example, in past q frames) and the frequency P be smaller than a threshold TH3.

The estimation section 324 associates speaker information regarding a speaker and a pitch frequency with each other and outputs the speaker information and the pitch frequency to the file obtaining unit 330. Each time the estimation section 324 estimates a pitch frequency, the estimation section 324 stores information regarding the estimated pitch frequency in the storage section 325. For example, the estimation section 324 may sequentially store information regarding an estimated pitch frequency in the storage section 325.

The storage section 325 stores information regarding pitch frequencies. The storage section 325 corresponds to a semiconductor memory such as a RAM, a ROM, or a flash memory or a storage device such as an HDD.

Figure 16:
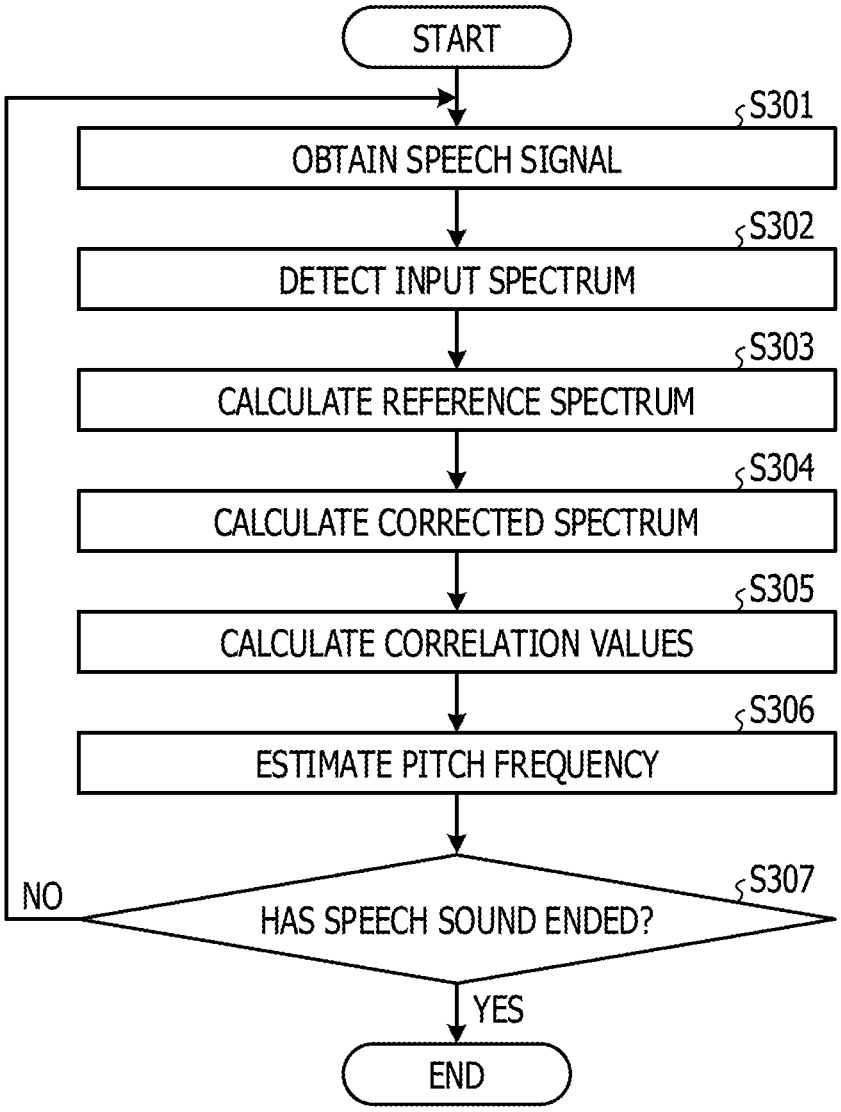
FIG. 16 is a flowchart illustrating a processing procedure used by the pitch detection unit according to the third embodiment.

Next, an example of a processing procedure used by the pitch detection unit 320 according to the third embodiment will be described. FIG. 16 is a flowchart illustrating the processing procedure used by the pitch detection unit 320 according to the third embodiment. As illustrated in FIG. 16, the detection section 321 of the pitch detection unit 320 obtains a speech signal (step S301). The detection section 321 detects an input spectrum based on the speech signal (step S302). The calculation section 322 of the pitch detection unit 320 calculates a reference spectrum (step S303). The correction section 323 of the pitch detection unit 320 corrects the input spectrum to calculate a corrected spectrum (step S304).

The estimation section 324 of the pitch detection unit 320 calculates correlation values between the corrected spectrum and periodic signals corresponding to frequencies in certain bands (step S305). The estimation section 324 estimates, based on the correlation values, a pitch frequency at which a maximum value of the correlation values is obtained (step S306).

The pitch detection unit 320 determines whether a speech sound has ended (step S307). If the speech sound has not ended (NO in step S307), the pitch detection unit 320 returns to step S301. If the speech sound has ended (YES in step S307), on the other hand, the pitch detection unit 320 ends the process.

Next, advantageous effects produced by the speech processing apparatus 300 according to the third embodiment will be described. The speech processing apparatus 300 estimates a pitch frequency of a speech signal based on correlation values between a corrected spectrum and periodic signals corresponding to frequencies in certain bands. Since the corrected spectrum indicates local maxima of the input spectrum with the same amplitude, decreases in the input spectrum or some harmonics do not affect the correlation values, insofar as the local maxima are maintained. As a result, the accuracy of estimating a pitch frequency improves.

In addition, if pitch frequencies output in past q frames are denoted by P1, P2, . . . , and Pq, and if any of P−P1, P−P2, . . . , and P−Pq is smaller than the threshold TH3, the speech processing apparatus 300 outputs the pitch frequency P. If the pitch frequency P is deviated due to noise or the like, for example, the above condition is not satisfied, and the incorrect pitch frequency P is not output.

Figure 17:
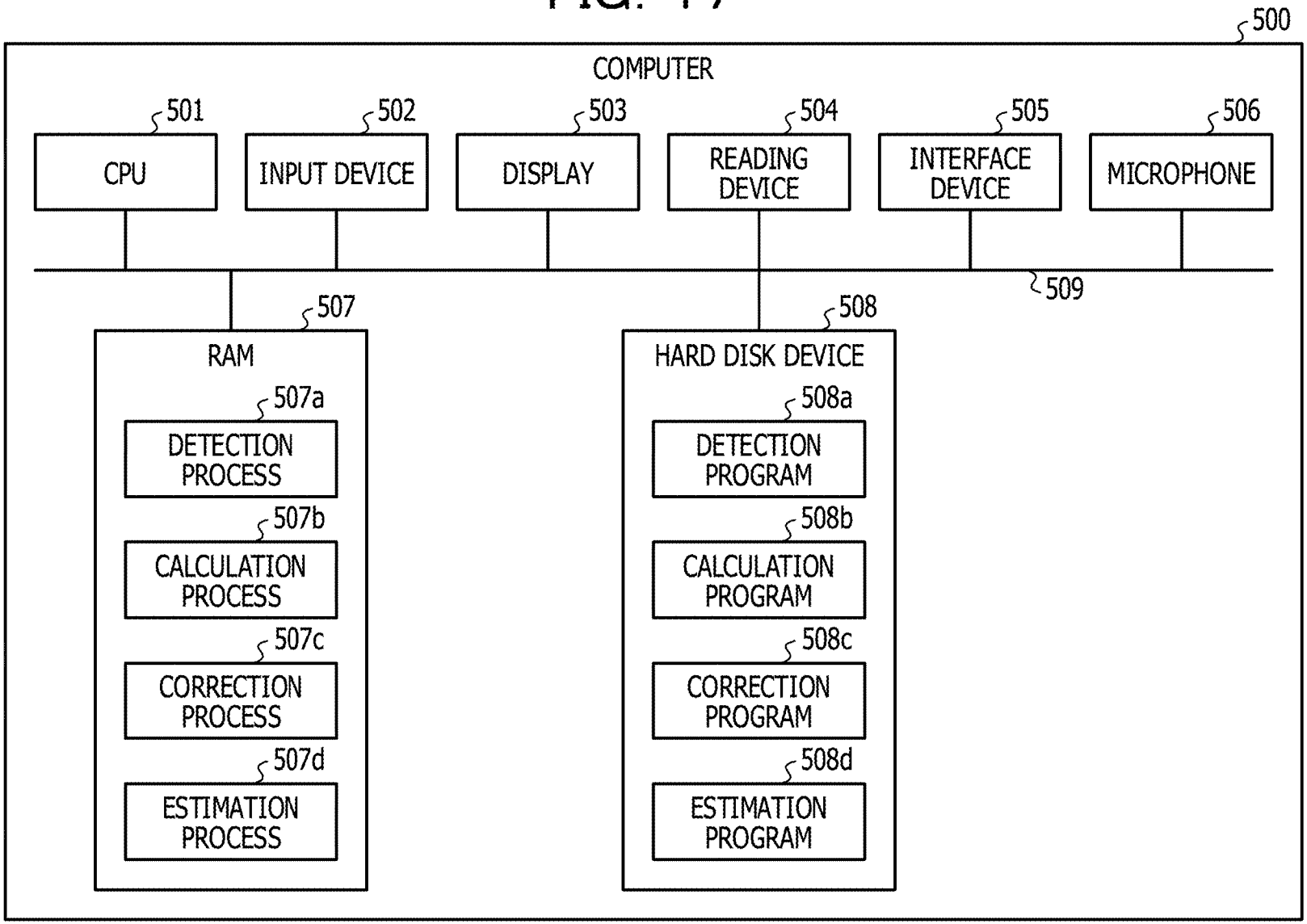
FIG. 17 is a diagram illustrating an example of the hardware configuration of a computer that achieves the same functions as those of the speech processing apparatuses.
Figure 18:
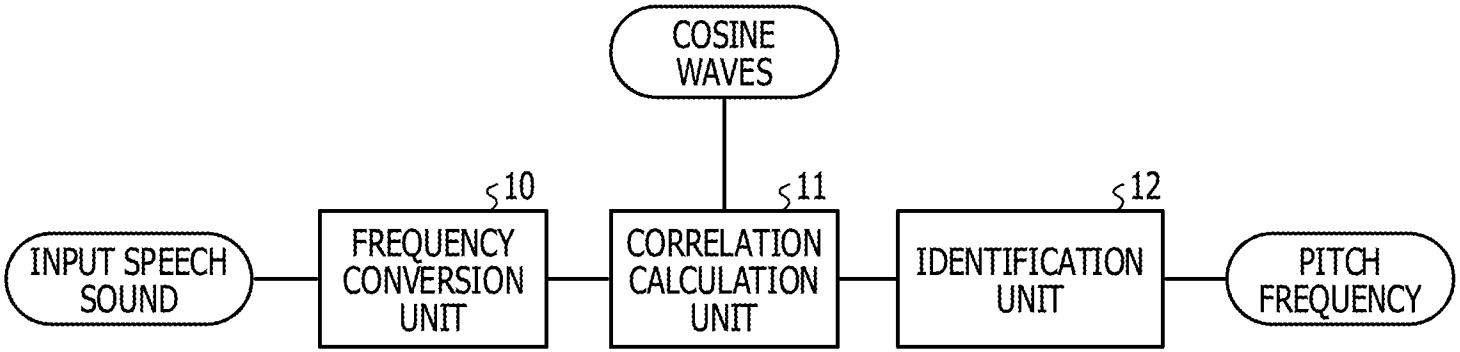
FIG. 18 is a first diagram illustrating an example of the related art.
Figure 19:
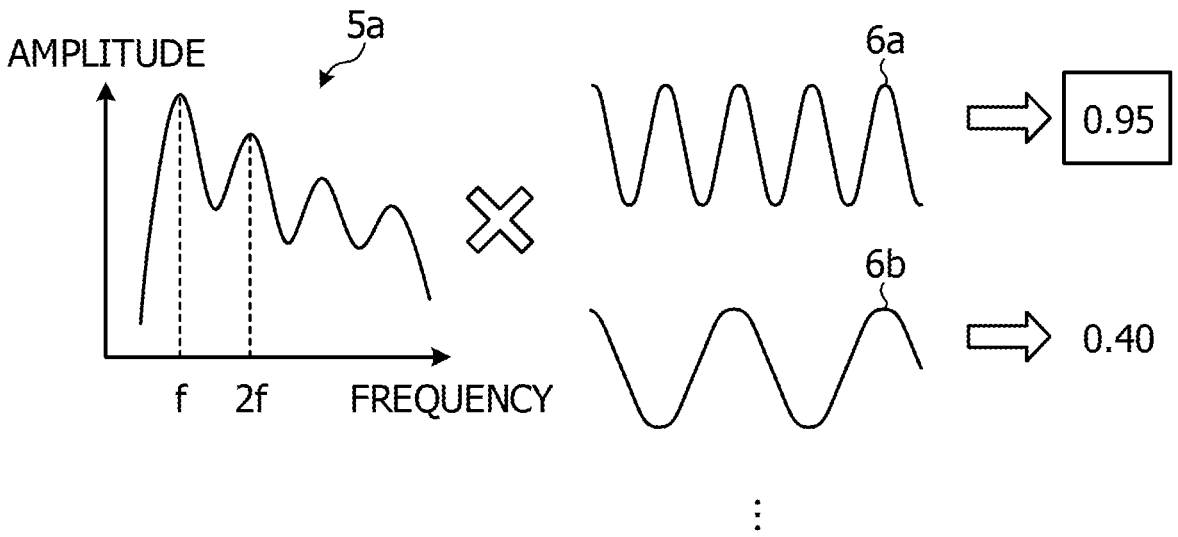
FIG. 19 is a second diagram illustrating the example of the related art.

Next, an example of the hardware configuration of a computer that achieves the same functions as those of the speech processing apparatuses 100, 200, and 300 according to the above embodiments will be described. FIG. 17 is a diagram illustrating an example of the hardware configuration of the computer that achieves the same functions as those of the speech processing apparatuses 100, 200, 300.

As illustrated in FIG. 17, a computer 500 includes a CPU 501 that performs various arithmetic processes, an input device 502 that receives data from a user, and a display 503. The computer 500 also includes a reading device 504 that reads a program or the like from a storage medium and an interface device 505 that communicates data with a recording apparatus or the like through a wired or wireless network. The computer 500 also includes a microphone 506. The computer 500 also includes a RAM 507 that temporarily stores various pieces of information and a hard disk device 508. The components 501 to 508 are connected to a bus 509.

The hard disk device 508 includes a detection program 508*a*, a calculation program 508*b*, a correction program 508*c*, and an estimation program 508*d*. The CPU 501 reads the detection program 508*a*, the calculation program 508*b*, the correction program 508*c*, and the estimation program 508*d* and loads the detection program 508*a*, the calculation program 508*b*, the correction program 508*c*, and the estimation program 508*d* into the RAM 507.

The detection program 508*a* functions as a detection process 507*a*. The calculation program 508*b* functions as a calculation process 507*b*. The correction program 508*c* functions as a correction process 507*c*. The estimation program 508*d* functions as an estimation process 507*d*.

The detection process 507*a* corresponds to the process performed by the detection units 120 and 230 and the detection section 321. The calculation process 507*b* corresponds to the process performed by the calculation units 130 and 240 and the calculation section 322. The correction process 507*c* corresponds to the process performed by the correction units 140 and 250 and the correction section 323. The estimation process 507*d* corresponds to the process performed by the estimation units 150 and 260 and the estimation section 324.

The programs 508*a* to 508*d* do not have to be stored in the hard disk device 508 in advance. For example, the programs 508*a* to 508*d* may be stored in a portable physical medium such as a flexible disk (FD), a compact disc read-only memory (CD-ROM), a digital versatile disc (DVD), a magneto-optical (MO) disk, or an integrated circuit (IC) card insertable into the computer 500. The computer 500 may then read and execute the programs 508*a* to 508*d*.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A method for processing speech, the method comprising:

executing a acquiring process that includes acquiring a speech signal;

executing a detection process that includes detecting a first spectrum from the speech signal;

executing a calculation process that includes calculating a second spectrum based on an envelope of the first spectrum, the calculating of the second spectrum being configured to smooth the first spectrum in a frequency direction;

executing a correction process that includes correcting the first spectrum based on comparison between a first amplitude of the first spectrum and a second amplitude of the second spectrum, the correcting of the first spectrum being configured to obtain a differential spectrum by the comparison, change an amplitude of the first spectrum to a first value when the differential spectrum is larger than a threshold, and change an amplitude of the first spectrum to a second value being smaller than the first value when the differential spectrum is equal to or smaller than the threshold;

executing a estimation process that includes estimating a pitch frequency of the speech signal in accordance with correlation between the corrected first spectrum and periodic signals corresponding to frequencies in a certain band, the corrected first spectrum being represented by the first value and the second value.

2. The method according to claim 1, wherein the calculation process is configured to calculate the second spectrum by smoothing the first spectrum.

3. The method according to claim 1, wherein the calculation process is configured to connect each of local maxima of the first spectrum to one another, and calculate the second spectrum by translating the each of local maxima connected to each another in parallel.

4. The method according to claim 1, wherein the calculation process is configured to calculate a spectrum envelope of the first spectrum, and calculate the second spectrum by translating the spectrum envelope in parallel.

5. The method according to claim 1, wherein the estimation process is configured to estimate the pitch frequency in accordance with a frequency of the periodic signals which have a maximum value of the correlation with the corrected first spectrum, the maximum value being greater than or equal to a threshold.

6. The method according to claim 1, further comprising:

executing a second correction process that includes correcting the pitch frequency in accordance with the first amplitude of the first spectrum corresponding to integral multiples of the pitch frequency.

7. The method according to claim 1, further comprising:

executing a third correction process that includes sequentially storing, in a memory, information regarding the pitch frequency estimated by the estimation process, and correcting a first pitch frequency within a first time period in accordance with a second pitch frequency indicated by the stored information regarding the pitch frequency, the second pitch frequency being within a second time period before the first time period.

8. The method according to claim 7, further comprising:

executing an output process that includes estimating the speech signal in accordance with the stored information regarding the pitch frequency, and displaying a result of the estimating process.

9. An information processing apparatus for processing speech, the information processing apparatus comprising:

a memory; and a processor coupled to the memory and configured to execute a acquiring process that includes acquiring a speech signal, execute a detection process that includes detecting a first spectrum from the speech signal, execute a calculation process that includes calculating a second spectrum based on an envelope of the first spectrum, the calculating of the second spectrum being configured to smooth the first spectrum in a frequency direction, execute a correction process that includes correcting the first spectrum based on comparison between a first amplitude of the first spectrum and a second amplitude of the second spectrum, the correcting of the first spectrum being configured to:

obtain a differential spectrum by the comparison;

change an amplitude of the first spectrum to a first value when the differential spectrum is larger than a threshold; and change an amplitude of the first spectrum to a second value being smaller than the first value when the differential spectrum is equal to or smaller than the threshold, and execute a estimation process that includes estimating a pitch frequency of the speech signal in accordance with correlation between the corrected first spectrum and periodic signals corresponding to frequencies in a certain band, the corrected first spectrum being represented by the first value and the second value.

10. The information processing apparatus according to claim 9, wherein the calculation process is configured to calculate the second spectrum by smoothing the first spectrum.

11. The information processing apparatus according to claim 9, wherein the calculation process is configured to connect each of local maxima of the first spectrum to one another, and calculate the second spectrum by translating the each of local maxima connected to each another in parallel.

12. The information processing apparatus according to claim 9, wherein the calculation process is configured to calculate a spectrum envelope of the first spectrum, and calculate the second spectrum by translating the spectrum envelope in parallel.

13. The information processing apparatus according to claim 9, wherein the estimation process is configured to estimate the pitch frequency in accordance with a frequency of the periodic signals which have a maximum value of the correlation with the corrected first spectrum, the maximum value being greater than or equal to a threshold.

14. The information processing apparatus according to claim 9, wherein the processor is configured to execute a second correction process that includes correcting the pitch frequency in accordance with the first amplitude of the first spectrum corresponding to integral multiples of the pitch frequency.

15. The information processing apparatus according to claim 9, wherein the processor is configured to execute a third correction process that includes sequentially storing, in the memory, information regarding the pitch frequency estimated by the estimation process, and correcting a first pitch frequency within a first time period in accordance with a second pitch frequency indicated by the stored information regarding the pitch frequency, the second pitch frequency being within a second time period before the first time period.

16. The information processing apparatus according to claim 15, further comprising:

executing an output process that includes estimating the speech signal in accordance with the stored information regarding the pitch frequency, and displaying a result of the estimating process.

17. A non-transitory computer-readable storage medium for storing a speech processing program that causes a processor to execute a process, the process comprising:

executing a acquiring process that includes acquiring a speech signal;

executing a detection process that includes detecting a first spectrum from the speech signal;

executing a calculation process that includes calculating a second spectrum based on an envelope of the first spectrum, the calculating of the second spectrum being configured to smooth the first spectrum in a frequency direction;

executing a correction process that includes correcting the first spectrum based on comparison between a first amplitude of the first spectrum and a second amplitude of the second spectrum, the correcting of the first spectrum being configured to obtain a differential spectrum by the comparison, change an amplitude of the first spectrum to a first value when the differential spectrum is larger than a threshold, change an amplitude of the first spectrum to a second value being smaller than the first value when the differential spectrum is equal to or smaller than the threshold;

executing a estimation process that includes estimating a pitch frequency of the speech signal in accordance with correlation between the corrected first spectrum and periodic signals corresponding to frequencies in a certain band, the corrected first spectrum being represented by the first value and the second value.

18. The non-transitory computer-readable storage medium according to claim 17, wherein the calculation process is configured to calculate the second spectrum by smoothing the first spectrum.

19. The non-transitory computer-readable storage medium according to claim 17, wherein the calculation process is configured to connect each of local maxima of the first spectrum to one another, and calculate the second spectrum by translating the each of local maxima connected to each another in parallel.

20. The non-transitory computer-readable storage medium according to claim 17, wherein the calculation process is configured to calculate a spectrum envelope of the first spectrum, and calculate the second spectrum by translating the spectrum envelope in parallel.

* * * * *